US011499333B2

(12) United States Patent
Thompson et al.

(10) Patent No.: US 11,499,333 B2
(45) Date of Patent: Nov. 15, 2022

(54) FENCE POST SUPPORT AND METHOD AND BLANK FOR MAKING SAME

(71) Applicants: Luke Travis Thompson, Marietta, GA (US); Truett Ramsey Thompson, Raleigh, NC (US)

(72) Inventors: Luke Travis Thompson, Marietta, GA (US); Truett Ramsey Thompson, Raleigh, NC (US)

( * ) Notice: Subject to any disclaimer, the term of this patent is extended or adjusted under 35 U.S.C. 154(b) by 0 days.

(21) Appl. No.: 17/091,231

(22) Filed: Nov. 6, 2020

(65) Prior Publication Data

US 2021/0140190 A1 May 13, 2021

Related U.S. Application Data

(60) Provisional application No. 62/932,835, filed on Nov. 8, 2019.

(51) Int. Cl.
*E04H 12/22* (2006.01)

(52) U.S. Cl.
CPC ..... *E04H 12/2292* (2013.01)

(58) Field of Classification Search
CPC ..... E04H 12/2292; E04H 12/2253; E04H 12/347; E04H 17/263; E04H 12/22; E04H 12/2215; B65D 2571/0066; B65D 5/4266; B65D 2571/00277; E02D 27/42; E02D 5/80

See application file for complete search history.

(56) References Cited

U.S. PATENT DOCUMENTS 287,923 A * 11/1883 Gorla ..... E04H 12/2215 52/154
1,361,345 A * 12/1920 Antonp ..... E04H 17/10 52/165
2,955,735 A * 10/1960 Inman ..... B65D 85/325 206/521.4
4,004,383 A * 1/1977 Watanabe ..... E04H 12/2215 52/154
4,641,478 A * 2/1987 Nelson, Jr. ..... E04H 12/22 52/700
5,333,435 A * 8/1994 Leek ..... E04B 1/2608 52/296

FOREIGN PATENT DOCUMENTS

DE 1928145 A1 * 1/1970 ..... E04H 12/2215
FR 2649169 A1 * 1/1991 ..... A01K 3/00
WO WO-2017219061 A1 * 12/2017 ..... E04H 12/223
WO WO-2019102299 A1 * 5/2019 ..... E04H 12/22

* cited by examiner

*Primary Examiner* — Theodore V Adamos
(74) *Attorney, Agent, or Firm* — McDonald Hopkins LLC

(57) ABSTRACT

A structure for receiving and stabilizing a fence post or other similar support, as well as methods of making and using and a material blank for forming the same, are all described. The support has a flat planar member, into which a series of cooperating notches/slits, recesses, and perforations or frangible connections are provided. When assembled, the support is defined by a pair of axially aligned planar members, cooperatively fitted to form supported receiving recesses at a predetermined axial offset from the non-receiving edge of the support. A method of securing such supports for subsequent encasement in concrete is also contemplated.

9 Claims, 4 Drawing Sheets

FENCE POST SUPPORT AND METHOD AND BLANK FOR MAKING SAME

REFERENCE TO RELATED APPLICATIONS

This application claims priority to U.S. Provisional Patent Application Ser. No. 62/932,835 filed on Nov. 8, 2019 and is incorporated by reference herein.

TECHNICAL FIELD

This disclosure relates generally to methods and an apparatus for positioning tubular or solid posts within a hole or recess that is to be filled with concrete or similar materials, as well as a material blank useful in such methods and for making such apparatus.

BACKGROUND

Every year, millions of linear feet of chain link and other prefabricated fences are installed. These installations rely upon regularly spaced apart fence posts that are vertically positioned and secured to a base. Often, these posts are formed as hollow circular tubes (possibly sealed or closed off at the above ground end).

While it is possible to drive the posts into the ground, this method is not preferred for a number of reasons. Foremost, variable and/or unstable soil conditions could lead to the post sagging or slumping off of its preferred vertical orientation. In turn, non-vertical orientation could lead to an outright failure of the fence once the chain link webbing or other prefabricated material is rolled out and attached to the posts. Separately, rotting or galvanic and other corrosion can be a concern for certain types of posts provided in certain climates/environments.

Thus, as illustrated in FIG. 1, a preferred fence installation, such as a chain link or prefabricated fence, is based on a series of fence posts 2 are positioned approximately 8 to 10 feet apart, aligned to define the desired fence line, and positioned within preformed holes 10 in the ground that extend between 3 to 4 feet below the surface. These holes are at least 10 to 14 inches in diameter and, after the posts positioned upright (i.e., vertical) and centered, concreate encases the outer surface of the hollow post tube and may even penetrate upwards for distance into the hollow tube itself. In this manner, the post is secured once the concrete cures.

Rail clamps and/or sleeves 4 are affixed to the top end of the post, with a cap 6 nominally sealing the hollow tube. Optionally, top rail 8 may extend away from the clamp/sleeve 4 and pass through holders 9 affixed on certain posts 2. Chain link web 3 (partially illustrated) is then extended across the line formed by the posts 2, possibly held in place by stretcher rods 5 and/or other attachment means. Truss supports 7 can also be provided.

ASTM International (based in West Conshohocken, Pa.) publishes various standard s and codes that may provide further information. Accordingly, ASTM A121; A392; A824; C94/C94M; F567; F626; F668; F900; F934; F1034; F1083; F1184; F1664; F1665; F1910; F1911; F2200; and F2611 are all incorporated by reference herein. Other standards, procedures, and techniques will be known to those in the fencing industry so as to further inform the need for installing posts in a stable and consistent manner.

Consistent positioning of the posts within each hole facilitates the creation of durable and long-lasting fencing. When the post is simply driven into the ground at the bottom of its hole, the concrete only encases outer surface of the post can give rise to an unsightly "donut" at the base of each post. Further still, unwanted ground water, fluids, or even pests could penetrate into a post that is not encased in concrete (or other curable compositions) along its bottom.

In view of these shortcomings, U.S. Pat. No. 4,386,762 proposes a structure for use with wooden posts to prevent ground rot. U.S. Pat. Nos. 1,186,554; 2,718,382; 5,123,623; 5,704,188; and 5,975,500 all describe similar anchoring structures for posts. More generally, U.S. Pat. No. 5,555,693 and United States Publication 2007/0193189 contemplate rebar or general purpose construction chairs onto which a work piece can be seated.

None of these solutions are particularly amenable to today's construction environment. For example, some require the use of wooden posts, which can add considerable cost and subsequent maintenance concerns. Many of the others use excessive amounts of materials, which increase manufacture, transportation, and installation costs. Further still, the size and shape of some of these solutions may not be amendable to conventional, high volume installation techniques.

In view of the foregoing, a simple means for securing tubular or solid posts would be welcome. Further still, a solution that was compact, easy to transport, and economical to make—possibly even on site—would be a considerable improvement over now-available materials and methods.

SUMMARY OF INVENTION

Assemblies for securing the terminal end of fence posts and other similar supports, along with methods of making and using and a material blank for forming the same, are described. The assembly is made from a flat, elongated planar blank formed with specifically positioned, cooperating notches/slits, recesses, and perforations. The distal ends of the blank are detached and fitted orthogonally into central notches/slits to create a free-standing structure.

When assembled, the assembly is defined by a plurality of axially aligned planar members, cooperatively fitted to form a receiving recess at a predetermined offset from the edge of the support and/or from the central axis of the assembly. Apertures in the free-standing structure allow concrete or other similar fluids to penetrate the structure and enter the aperture at the end of the hollow tube that is, itself, received within a recess that can be supported/urged into place by one or more positioning arms.

A method of securing tubular or solid posts/supports for subsequent encasement in concrete and, optionally, for construction of a prefabricated fence, is also contemplated. Here, a blank similar to that described above is created/provided. The blank may be formed in a plastic, metal, or wooden sheet or plate. Preferably, the sheet/plate has a generally rectangular shape. As above, specific notches/slits, recesses, and perforations are formed in the blank to create symmetrical patterns along both horizontal and vertical axis of the sheet/plate. The aforementioned freestanding structure is then assembled by detaching sections and inserting them orthogonally into the main blank pieces. The structure is then provided into a hole, the post is seated within the recess, and the hole is filled with concrete or other flowable material(s) that eventually cure/set into a solid, hardened form. The positioning of the tube and the assembly of the structure ensures that concrete/flowable material penetrates through the blank and flows into the inner cavity of the tube to ensure a secure unit is formed upon curing of the concrete/material.

BRIEF DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

DESCRIPTION

Figure 1:
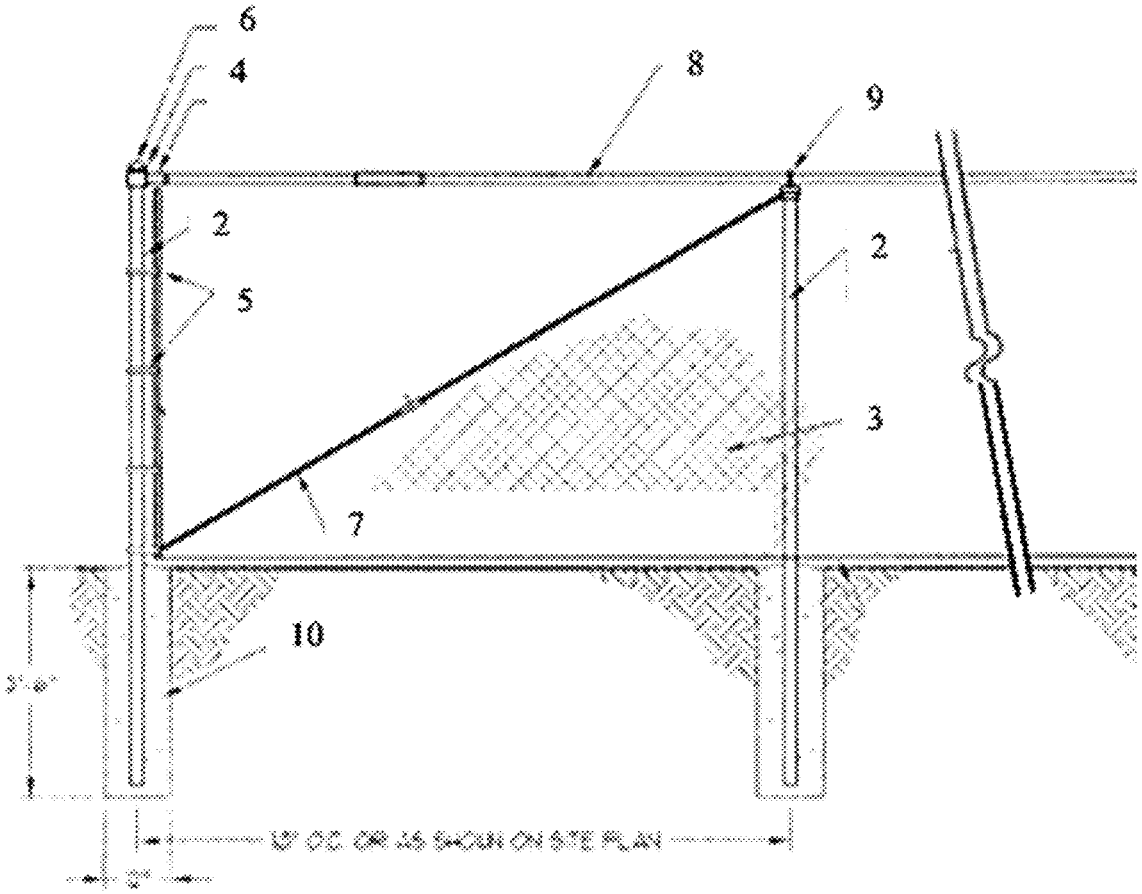
FIG. 1 is a schematic side view of a typical prefabricated fence installation, with representative subterranean post holes illustrated in cross section.
Figure 2:
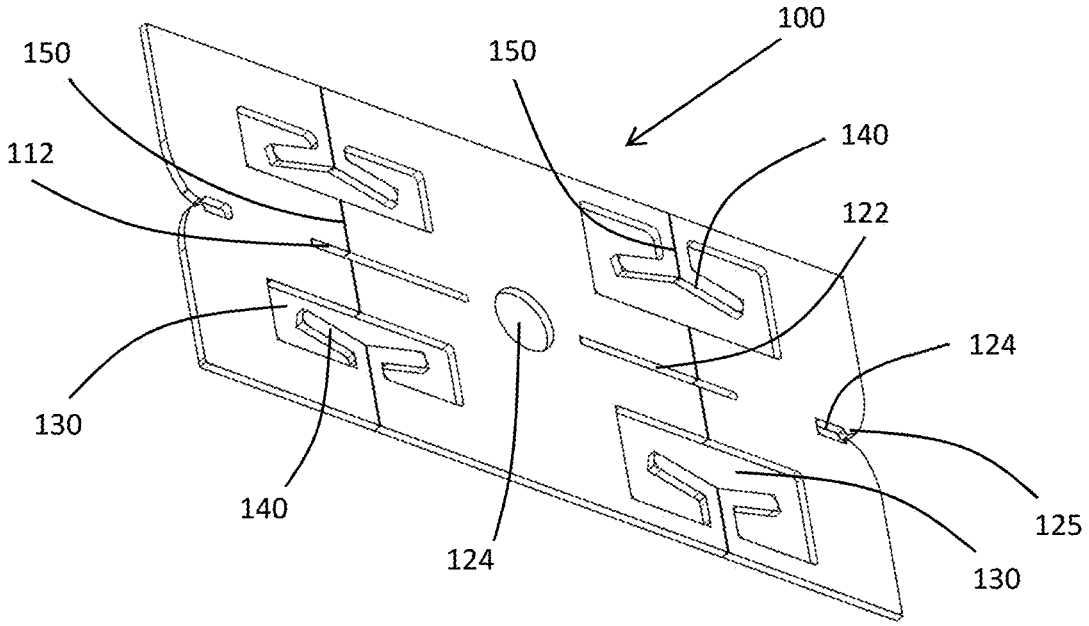
FIG. 2 is a perspective plan view of the material blank used to form the holder according to certain aspects of the invention.
Figure 3:
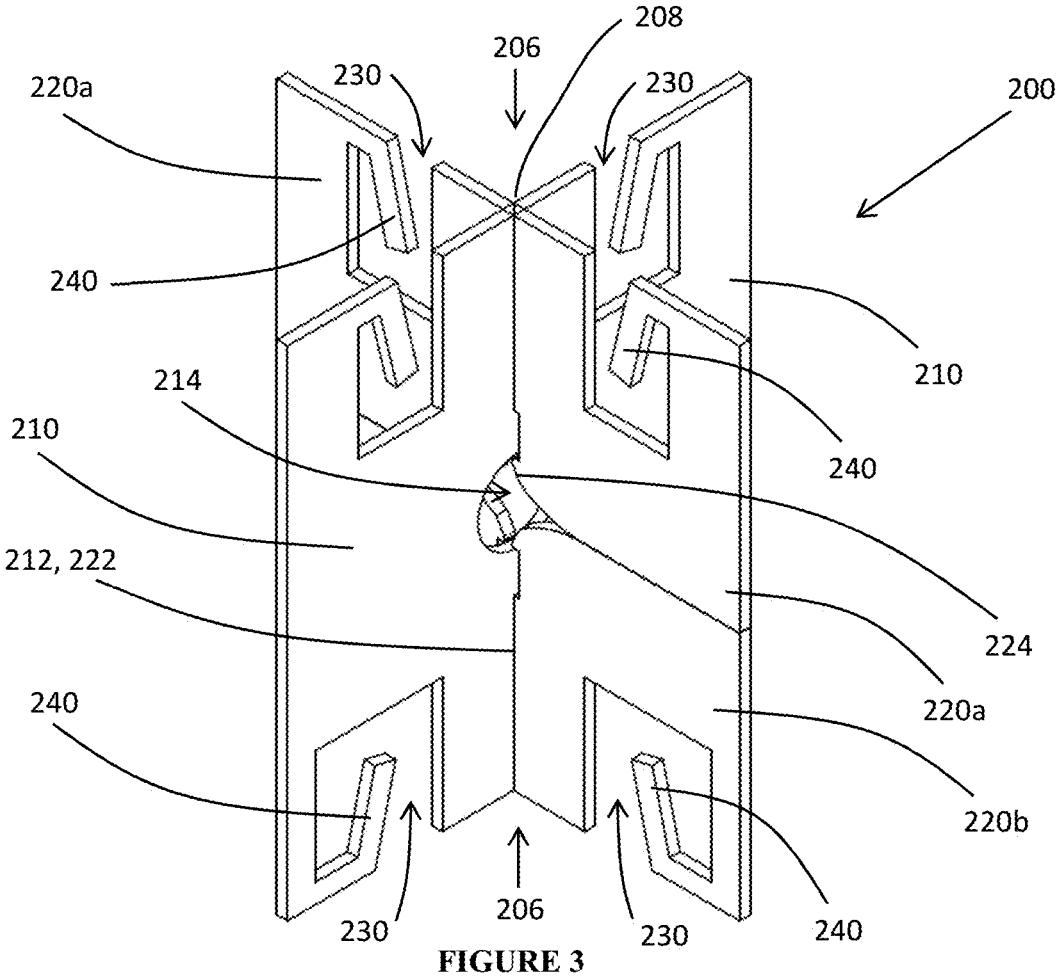
FIG. 3 is a perspective plan view of the holder as assembled according to certain aspects of the invention.
Figure 4:
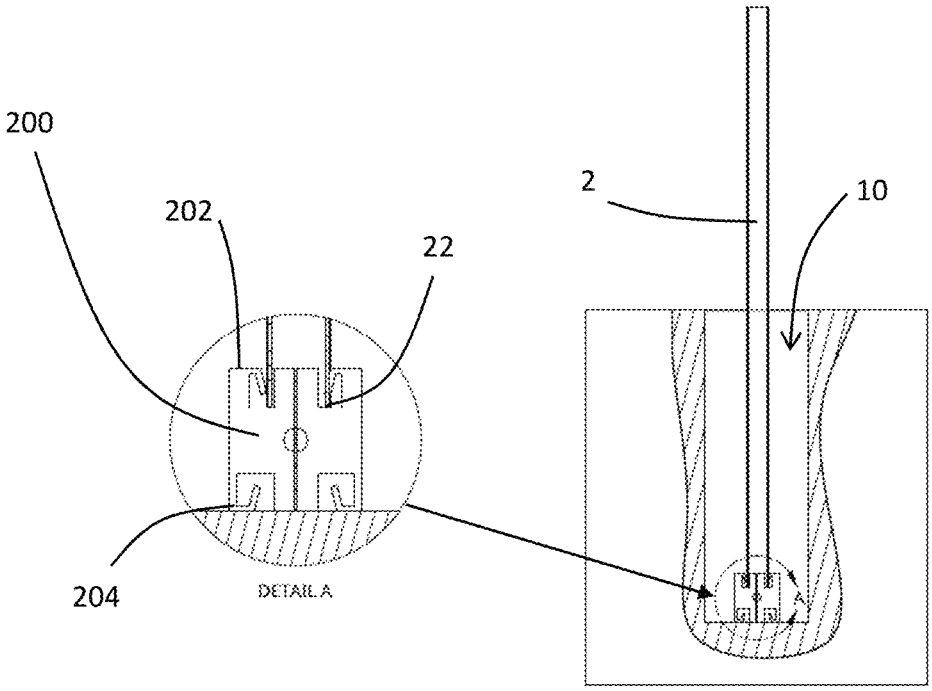
FIG. 4 is a schematic side view of the holder installed at the base of a post hole, with an exploded side view detail of callout A.
Figure 5:
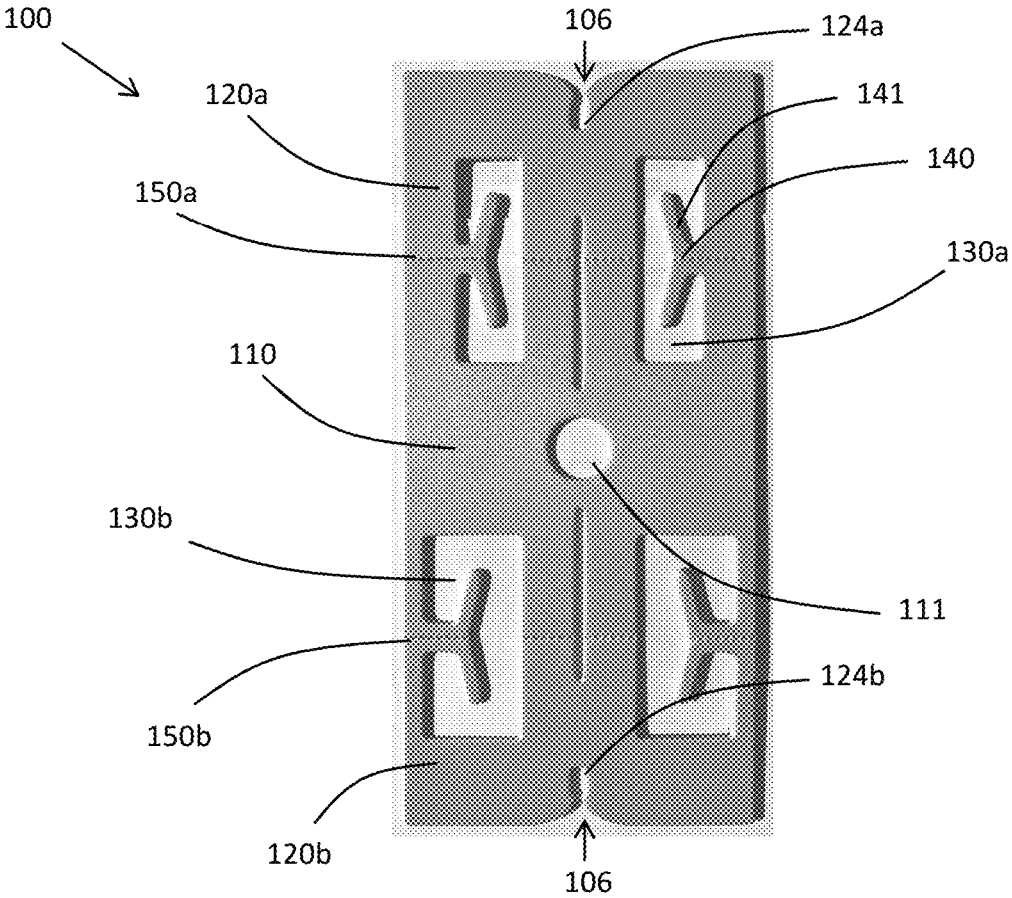
FIG. 5 is a top plan view of the material blank of FIG. 2.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

With reference to FIGS. 2 through 6, material blank 100 and support assembly 200 are shown. As used herein, the material blank is a preformed template which can be used to construct the support assembly. However, the support assembly can also be formed by other means, and the disclosure and claims resulting to this assembly should not be taken out of context to only relate to the blank and/or methods involving use of the blank.

Assembly 200 has two planar members 210, 220 coupled together at an angle sufficient to allow the assembly 200 to stand upright. Indents or gaps 230 are provided on at least the top edge 202 of the assembly. Each indent 230 includes a support arm or extension 240 that is generally oriented along or inclined toward the central vertical axis 206 of the assembly 200.

In use, the assembly 200 is positioned at the bottom of a post hole 10 with the indents 230 oriented upward to receive a member 20 (i.e., a hollow or solid post). The lower most edge of the indents 230 is uniform so as to allow the edge of the post 2 to be held level relative to the horizon, although that lower most edge is still elevated from the bottom edge 204 of the assembly. In this manner, when concrete or other flowable, curable substances intended to secure the post are deposited in the hole, the concrete is able to flow beneath the bottom 22 of the post 20, into the hollow interstice of the post itself (when present) and, to the extent the assembly 200 includes additional indents or apertures elsewhere on the members 210, 220, through the assembly 200 itself so as to lock in and secure both the post and the assembly 200.

When view from the top, planar members 210, 220 preferably form a cross or X-shape in which the flat surface of each member 210, 220 is orthogonal to each adjacent surface. This shape ensures that the assembly 200 can remain seated in an upright position when placed in the hole. Preferably, the assembly 200 is fitted onto the post 20 before inserting either into the hole, in which case concrete may be poured before or after the post/assembly combination is positioned within the hole (if concrete is poured before, the subsequent placement of the post/assembly must occur before the concrete begins to solidify).

Member 210 can be a single, elongated flat panel, preferably with a rectangular shape (further providing for rounded edges and the various indents and notches provided along its peripheral edges). Member 220 can be provided as two separate pieces 220*a*, 220*b*. When bifurcated in this manner, pieces 220*a*, 220*b* can be provided from opposing distal ends of the blank 100, as will be described in greater detail below.

Members 210 and 220 can be coupled by way of cooperating slits 212, 222 formed in edge of one or both respective members 210, 220. An additional notch 224 can be provided in member 220 (or, individually, pieces 220*a*, 220*b*) so as to couple to an aperture 214 formed in or near the center of member 210.

Support arms or extensions 240 protrude into the void defined by the indent 230 into which they extend. Arms 240 may present with an L-, C-shape, or D-shape so that an engaging surface (i.e., the portion of the arm coming into contact with the post) fits to and/or flexibly conforms with the post. The arms 240 preferably have similar shapes for all of the indents on one side of the assembly 200, although it is possible to vary the size and/or shape of the arms 240 at the top as compared to at the bottom, as this approach allows a single blank 100 or assembly 200 to be useful with posts of differing diameters.

Optionally, the indents 230 could be formed as slits sized to match the wall thickness of a hollow tubular post (see blank 300 below). Such slits could be used in conjunction with or in place of a more conventionally shaped aperture and extension arm 240.

Notably, when members 210, 220 are assembled, the indents 230 and, to the extent present, support arms 240 are spaced apart at the same distance relative to the central connection point 208. In this manner, the post 2 is properly seated on the assembly 200.

Generally speaking, the width of the members 210, 220 should be similar or identical. Further, that width should be selected to fit into common sizes for post holes 10 and, separately, to accommodate common outer diameters (and, when appropriate, inner diameters) for the posts themselves. Typically, the width will be less than or equal to the length of the members 210, 220 and, more specifically, less than 24 inches, less than 12 inches, and less than 10 inches. The minimum width merely needs to accommodate the various features noted above, but it would typically be expected to be at least 4 inches, at least 6 inches, at least 8 inches, or at least 10 inches.

In a similar manner, the length of the members 210, 220 will be selected to accommodate creation of the various features noted above. Equally significant, the length should also allow for the desired elevation of the post 2 away from the bottom of the hole 10 (e.g., usually about 3 inches). Also, the length is typically greater than the widths noted above, but will not exceed the depth of the hole 10. More likely, the length need not exceed 24 inches, 18 inches, 12 inches, or 10 inches.

The thickness of the members 210, 220 will be selected based upon the amount of support needed to hold up the post 2. Thus, the rigidity of the material selected for the members 210, 220 (as well as the blank 100 itself) may be more determinative than any particular range of dimensions. Nevertheless, in all aspects, the thickness of the substrates will be less than 1 inch, less than 0.75 inches, less than 0.5 inches, or less than 0.25 inches.

All of the dimensions (width, length, and height) can be expressed individually or relative to one another (e.g., as aspect ratios). The final dimensions can also be influenced by the manufacturing processes. However, in all instances, it would be preferable to minimize the use of materials and the need for specialized machining/cutting in order to save costs.

Blanks 100, 300 are useful and convenient means for creating the assembly 200. Generally speaking, these blanks are preformed from plastic, cardboard, or metal substrates. The various slits 112, 122, notches 124, apertures 111, 130, and support arms 140 can be cut, stamped, machined, or molded from the initial substrate. The use of perforations 150 and/or frangible bridge connectors 350 allow the substrate to be separated into a main central body 110 and complimentary segment 120 or segments 120*a*, 120*b*. Note that all of the aforementioned elements have the same shape and function as described for the assembly 200 (in fact, the final two digits of the reference numerals match so as to reinforce that connection, and it will be further understood that a general reference to a main reference numeral will encompass any instance where two or more segments share that main numeral, e.g. element 150 also refers to 150*a* and 150*b*, etc.).

Thus, blank 100 includes main body 110 and distal segments 120*a*, 120*b* that are defined by corresponding perforation lines 150*a*, 150*b*. Thus, main body 110 is bounded on the top and the bottom by segments 120*a*, 120*b*. The length-wise edges of the blank 100 can be substantially straight and free from any indents or slits.

In turn, the width-wise edges of the blank 100 correspond to edges of segments 120*a*, 120*b*. More specifically, notches 124*a*, 124*b* are formed at the center of the width-wise edge, which also happens to coincide with central length-wise or vertical axis 106. When the segments 120 are detached, the edge having notch 124 is inserted/fitted through the slit 112. Optionally, a portion of slit 112 can be carried over onto one or both segments 120*a*, 120*b* so as to impart slit 122 thereon.

Perforation lines 150 are cut width-wise or horizontally across the blank 100. For ease of detachment, these lines 150 should be generally straight. Also, lines 150 bisect the apertures 130 and, when present aperture 111 and/or support arms 140, as this will create the desired mirror-image shapes recommended for the indents, support arms, etc. found in the assembly 200.

A pattern of apertures 130 are provided in the blank 100. These apertures 130 are spaced apart equally from the central axis 106 and have similar shapes to ensure proper seating of the tube within the indents formed by these apertures 130. In one aspect, the apertures 130*a* extending into the top segment 120*a* are larger (i.e., have a larger overall void area, perimeter, and/or shape) than those in the bottom segment 120*b* or vice versa. Alternatively, the apertures 130*a* and 130*b* can be substantially identical. Notably, all of the length-wise edges closest to axis 106 in each aperture 130 are spaced at substantially the same distance from axis 106.

Support arms 140 may extend into the voids defined by apertures 130. Here, each arm 140 should connect to and extend from one of the length-wise edges of the aperture 130 (either closest to or farthest from axis 106). In one aspect, all arms 130 connect to the farthest edge.

The arms 140 preferably have lengthwise or vertical symmetry. Specifically, the arms 140 may have an angled shape resembling a Y- or a T-shape so that the angled portion 141 of the arm 140 can engage the post. Further, to the extent the perforation line 150 bisects any given arm 140, it will ensure that when the segment 120 is assembled to the body 110, the indents and support arms are aligned as described and required for the assembly 200.

Slits 112*a*, 112*b* coincide with the axis 106. Slits 112 should be sized to receive and cooperate with the thickness of the blank 100, so as to ensure body 110 and segments 120 can be assembled at the desired orientation (e.g., orthogonally). Notably, the configuration of notches 124 should adhere to the same sizing. However, notches 124 can include snap fitting protrusions 125. In turn, protrusions 125 would fit around the thickness of the blank 100 and rest within aperture 111 of the main body 110.

Slit 112 must be carried onto the body 110, although the extension of slit 112 onto the segments 120 (i.e., as slit portion 122) is optional.

Figure 6:
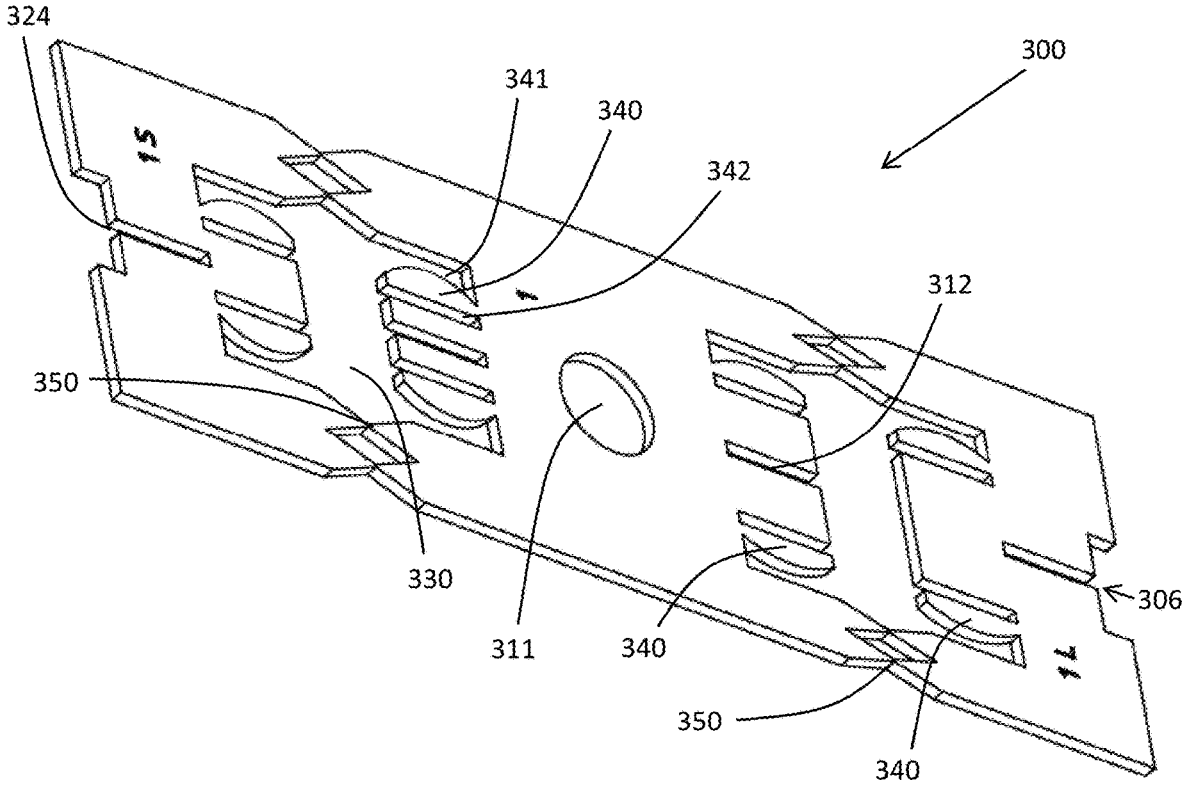
FIG. 6 is a perspective plan view of an alternative material blank used to form the holder according to certain aspects of the invention.

FIG. 6 shows an alternative arrangement to blank 100. Here, blank 300 operates on the same principles as blank 100, but with slight modifications to the indents and reliance upon frangible bridge connections 350 instead of one or more perforated lines. Apertures 311 and 330, slits 312, notches 324, and support arms 340 are formed on the respective and appropriate portions of body 310 and segments 320 as noted above. It should also be noted that the features in the periphery of each aperture 130 retain symmetry along the vertical axis 306 but not necessarily along the width-wise or horizontal axis coinciding with the frangible bridges 350 (a similar approach could be employed with blank 100).

Another feature of blank 300 that could be applied to blank 100 relates to the configuration of the support arms 340. Specifically, arms 340 are imparted with a D-shape so as to define a curving void 341 along one edge and effectively define a slit 342 on the opposing edge. Here, slit 342 (as well as void 341) would be sized to receive the wall of a tubular post. It is believed the curving surface of the arm 340 could facilitate sliding the post onto/in the void 341.

An advantage of the shapes used in blank 300 is that they present pointed, spike-like shapes along the lower edge. To the extent the indents and/or frangible connections in any of the blanks (or resultant assemblies) have such features, these features should allow the post/assembly combination to penetrate through concrete and/or embed into the bottom of the hole in which they are installed.

Another alternative arrangement for the assembly and blanks used to make such an assembly involves the use of a central body member/panel and a single complimentary segment, with that segment detached from only one end of the blank. Here, the central body still has a slit and indents along one edge similar to those described above, while the segment is configured with similar indents and a notch or slit that allows the body and the segment to fit together. When so fitted, all of the indents are aligned along a top of the resulting assembly so that a tubular or solid post can be received and attached within an upper planar surface formed and defined by the indents (possibly using support arms/extensions to better position and hold the post, also as described above). In this arrangement apertures could still be provided through the body and/or segment pieces to allow for concrete to flow through and better entrap the assembly and post.

The blanks and planar members described herein are envisioned to have a quadrilateral shape, with rectangles preferred but with square shapes also possible. However, these generalized shapes do not account for the indents, support arms, slits, and notches which must also be provided. Further, it may be possible to round or taper the edges and corners of the generalized quadrilateral shape. Further still, other polygonal shapes could be used.

In the same manner, the panels and planar members will have a length and width that greatly exceeds the thickness of that part. In this manner, the blanks and assemblies will minimize the use of material and can be transported, prior to assembly, in a flattened state.

While mirror-image or a pair of cooperating support arms are shown, it is possible to configure the blank and the assembly (along with the methods attendant thereto) so that only a single arm is provided/engages the fence post. In this configuration, the arm could bias the post against the edge of the corresponding aperture (i.e., the aperture not having a support arm in it).

The posts referred to herein will have an elongated cylindrical tube. While circular or square cylinders are most commonly employed, virtually any polygonal shape is contemplated. Further curved or irregular shapes could be accommodated by way of changing the shape of the indents and/or support arms. Also, while hollow tubular are envisioned to work particularly well, modifications could also be made in the indents and/or support arms to receive solid objects.

Once a single post is secured within a hole as described above, it will follow that a plurality of posts could be so secured. Further, this plurality would be configured along a desired fence line. In this manner, methods of constructing a prefabricated fence are also contemplated, with the understanding that a webbing or fence material would be affixed to the posts along the desired fence line after the concrete/curable material is sufficiently set.

As used herein, the term "bisect" means to divide a given element into two contiguous parts. It may also imply, but does not necessarily require, that the two parts result in mirror and/or symmetrical images.

In the same manner, "symmetrical" generally refers to positioning and, depending upon context, may encompass the specific shapes at issue. When the latter context applies, symmetrical will be understood to include reflectional symmetry so that the parts present as mirror images. However, the use of the term symmetrical should be read in context and, when appropriate, confined to the specific features (or combination of features) and the specific axis at issue. That means that half (or some other portion) of an element may be symmetrical whereas the remainder could be different.

"Orthogonal" means that two elements are aligned at approximately right angles relative to their major surfaces. In this regard, 90° angles might be preferred, but some natural variation can still exist. Further, a part may be orthogonal if it is inserted at a right angle but then becomes displaced from that preferred arrangement owing to deliberate manipulation or inadvertent movement while handling of the assembly.

While various aspects of the inventions are mentioned above, any specific combination of the features recited in the claims are expressly included in this disclosure. Thus, while a method of securing a post is recited including the blank described in claim 1, it is equally applicable to any of the other assemblies and subject matter disclosed or claimed herein. Similarly, the method may produce the various assembly configurations disclosed, claimed, or depicted herein. Still other methods, apparatus, and assembly will be apparent to skilled persons in view of the following description and drawings, all of which are expressly disclosed and contemplated as part of this description and/or claims.

All components should be made from materials selected to have sufficient structural integrity. The materials should also be selected for workability, longevity, cost, and weight. In addition to any materials specifically noted above, common polymers amenable processes contemplated herein should have particular utility. Cardboard, corrugated or reinforced paper materials, wood, synthetic composites, metallic and/or alloys sheets of metal and the like may be used in place of or in addition to polymers or other conventional materials.

References to coupling or attachment in this disclosure are to be understood as encompassing any of the conventional means used in this field. In addition to specific structures are depicted, these conventional means may take the form of snap- or force fitting of components, although bead-and-groove and/or slot-and-flange assemblies could be employed depending upon the context and feasibility of accommodating such alternative arrangements. Adhesive and fasteners could also be used for more permanent (i.e., non-detachable) connections, although such components must be judiciously selected so as to retain the underlying design goals inherent to the assembly, blank, and methods described herein.

The foregoing claims highlight still other features contemplated in certain embodiments. As such, that section is also incorporated into this disclosure and further informs the drawings.

We claim:

1. A material blank for forming a post holder assembly, the blank comprising:

an elongated substrate having a central aperture bisected by a central length-wise axis and a length-wise edge that is longer than a width-wise edge;

a pair of apertures through the elongated substrate arranged about the central length-wise axis, with each of the pair of apertures spaced apart at an equal distance from: (i) the central length-wise central axis and (ii) the width-wise edge;

at least one slit aligned along the length-wise central axis of the substrate;

a perforation formed transversely to the central length-wise axis and substantially parallel to the width-wise edge and bisecting each aperture and the at least one slit;

a notch provided in the elongated substrate on the width-wise edge and centered upon the central length-wise axis; and wherein the central aperture is configured to snap-fittingly receive the notch when, after an edge piece is formed by detachment along the perforation, the edge piece is fitted orthogonally into the at least one slit.

2. The material blank of claim 1 wherein each of the pair of apertures includes a support arm extending partially into a middle void thereof and wherein the perforation bisects every support arm.

3. The material blank of claim 2 wherein every support arm has a T-shape.

4. The material blank of claim 2 wherein every support arm includes a length-wise biasing extension piece formed at an angle relative to the central length-wise axis.

5. The material blank of claim 2 wherein every support arm forms a symmetrical shape relative to the perforation bisecting said support arm.

6. The material blank of claim 2 wherein every support arm defines a C-shaped aperture.

7. The material blank of claim 1 wherein the pair of apertures are symmetrically formed relative to the central length-wise axis.

8. The material blank of claim 1 wherein the elongated substrate is substantially rectangular.

9. An assembly for securing terminal ends of a post constructed from the material blank of claim 1, the assembly comprising:

an elongated, planar central body formed from a first portion of the elongated substrate; and a planar complimentary segment having substantially similar thickness in comparison to the elongated, planar central body and formed from a second portion of the elongated substrate;

wherein the first portion is detached from the second portion along the perforation; and wherein the elongated, planar central body includes a portion of the at least one slit, with the at least one slit exposed along an upper edge of the central body, and a portion of each of the pair of apertures remaining on the elongated, planar central body are exposed along the upper edge of the elongated, planar central body;

wherein the complimentary segment includes the notch and a portion of the pair of apertures remaining on the complimentary segment are exposed on an upper edge of the complimentary segment;

wherein, when the central body is separated from and assembled to the complimentary segment, the at least one slit receives a portion of the complimentary segment at the notch so as to couple the central body to the complimentary segment along the central length-wise axis at an angle allowing the assembly to stand upright; and wherein, when the assembly is upright, the a top facing of the assembly includes the upper edges of the elongated, planar central body and the complimentary segment so as to be configured to receive a terminal end of a post.

* * * * *